United States Patent [19]

Carlsson

[11] Patent Number: 4,784,076

[45] Date of Patent: Nov. 15, 1988

[54] BOOM ELEMENT, PARTICULARLY A CABIN OR A BERTH IN A SHIP

[75] Inventor: Rolf Carlsson, Billdal, Sweden

[73] Assignee: ACCI HB, Sweden

[21] Appl. No.: 9,335

[22] PCT Filed: Apr. 23, 1986

[86] PCT No.: PCT/SE86/00186

§ 371 Date: Dec. 24, 1986

§ 102(e) Date: Dec. 24, 1986

[87] PCT Pub. No.: WO86/06341

PCT Pub. Date: Nov. 6, 1986

[30] Foreign Application Priority Data

Apr. 26, 1985 [SE] Sweden ..... 8502028

[51] Int. Cl.[4] ..... B63B 29/02

[52] U.S. Cl. ..... 114/71; 52/262; 114/78

[58] Field of Search ..... 114/71, 78; 52/79.1, 52/79.5, 79.9, 79.12, 220, 221, 262, 264, 275, 276, 278, 283, 284

[56] References Cited

U.S. PATENT DOCUMENTS

| | | | |
|---|---|---|---|
| 3,054,481 | 9/1962 | Johnson et al. | 52/262 |
| 3,651,776 | 3/1972 | Hopeman, Jr. et al. | 114/71 |
| 4,018,021 | 4/1971 | Dow | 52/262 |

FOREIGN PATENT DOCUMENTS

| | | | |
|---|---|---|---|
| 967324 | 5/1975 | Canada | 52/283 |
| 414694 | 11/1980 | Sweden . | |

*Primary Examiner*—Joseph F. Peters, Jr.
*Assistant Examiner*—Edwin L. Swinehart
*Attorney, Agent, or Firm*—Ostrolenk, Faber, Gerb & Soffen

[57] ABSTRACT

A room structure to be located on a deck. A plurality of independent wall members flanged at their lower ends for connection to the deck. Grooved members interconnect the tops of adjacent wall members. Roof members span the tops of the wall members. Each set of roof members of a room structure includes at least one beam containing a supply for electricity, heat and ventilation and also containing apparatus for using the same. The roof members include ceiling plates resting on the groove members and supported by the beam.

8 Claims, 4 Drawing Sheets

BOOM ELEMENT, PARTICULARLY A CABIN OR A BERTH IN A SHIP

The present invention relates to a room element, particularly a cabin or a berth arranged in a supporting framework such as a ship or the like, which room element is connected to a heating and ventilation system, and is supplied with heath, ventilation, electric current and the like from central supply mains arranged outside the room element, whereby the site-built room element comprises a number of pre-fabricated self-supporting wall members, which at the lower part are attached to the sub floor/deck via side flanges extending from the members.

BACKGROUND OF THE INVENTION

Passenger and crew cabines in ships nowadays often are module adapted, which is a prerequisite for a rational production and for having the possibility to use prefabricated room elements.

The most common type of prefabricated room elements, which have been used hitherto, are so called volume units, i.e. containers, comprising a complete cabin with shower and toilet room, and which volume unit has walls and roof, and with or without a floor. Such a construction requires a very high deck level and is, because of its volume and weight, very difficult to handle in narrow decks and they therefore commonly have to be mounted during building of the ship's hull. During this stage of building, the volume units however are obstructing the work. The volume units during their period of assembly, furthermore are exposed to mechanical damage and weather and winds and therefore have to be protected in a proper way. The volume units furthermore have to be dimensioned thus that they can be transported in a safe way without damages. This results in a higher weight per unit, which means that the volume units will be more expensive than rooms which are site-builded in spite of the time saved during assembly.

Hitherto known site-built room elements must have attachments for the wall members welded to the upper and the lower decks, and the roof of the room element is hung like a false ceiling in the upper deck. Usually, the room elements are built like frameworks, which frames are insulated and filled by panels, but also prefabricated wall elements can occur. This building method requires a lot of work and time. Furthermore, the wire laying for heat, water, ventilation, electricity, telephone etcetera, remains.

OBJECT AND MOST ESSENTIAL FEATURE OF THE INVENTION

The object of the present invention is to provide a room element, which can make use of the advantages gained with known systems, i.e. prefabricated elements and the volume units, but which does not show their disadvantages. The room elements thus shall be possible to be built from prefabricated members, which are easy to handle and assemble, which room elements shall be selfsupporting relative to the upper deck of the ship, the bulkheads, shall plating, etcetera, and they shall be designed and adapted thus that the supply means for the media necessary for the room elements are included in the members. This has been obtained thereby that the wall elements in the upper part are interconnected by means of groove-formed connecting sections designed straight, L- or T-shaped and intended to enclose the upper part of the wall elements for keeping the separate members together in the longitudinal direction of the walls and also at corner and wall connections, that the roof of the room element is divided into at least three sections, where the middle section and every second section, respectively, are beams extending from one wall element to another, which beam is designed on one hand as a support for ribbed plate ceilings arranged transversely to the beam, and having their opposite ends supported on said connecting sections, and on the other hand as carriers for supply means for the room element, such as channels, conduits, tubes and the like.

DESCRIPTIONS OF THE DRAWINGS

The invention hereinafter will be further described as an embodiment with reference to the accompanying drawings.

Figure 3A:
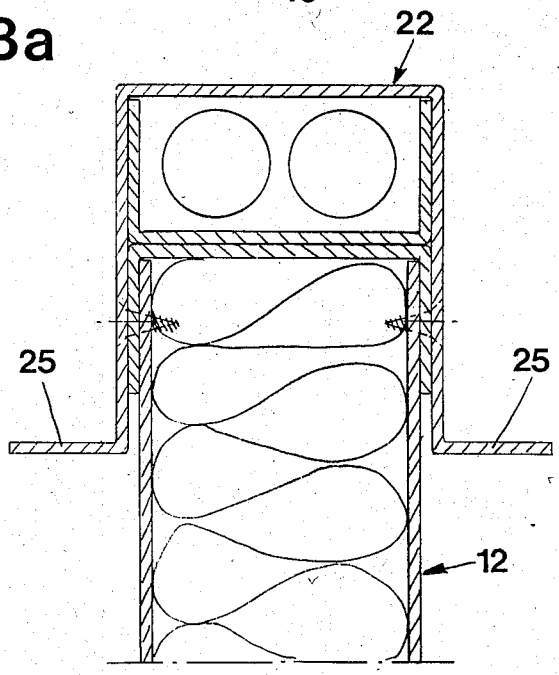
FIG. 3 shows in enlarged scale a section through a wall element.
Figure 3:
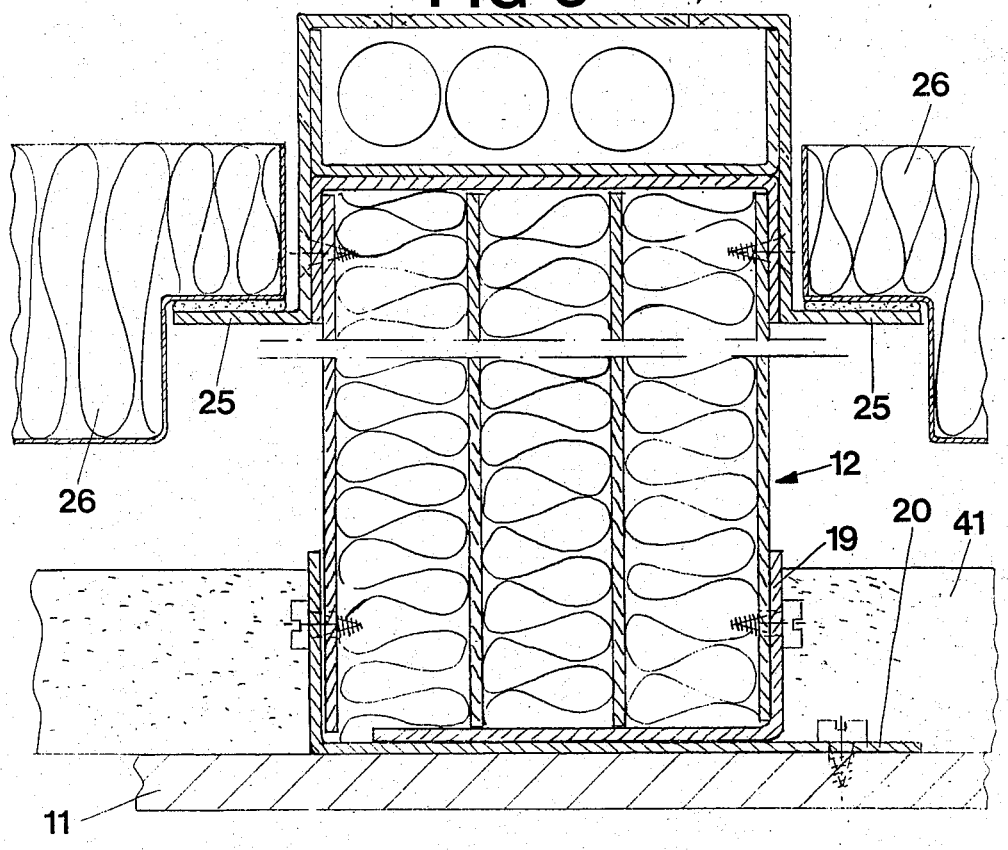

FIG. 3*a* is a section through a part of a wall element, like the one in FIG. 3 but thinner, the construction e.g. being intended for partition walls.

Figure 4:
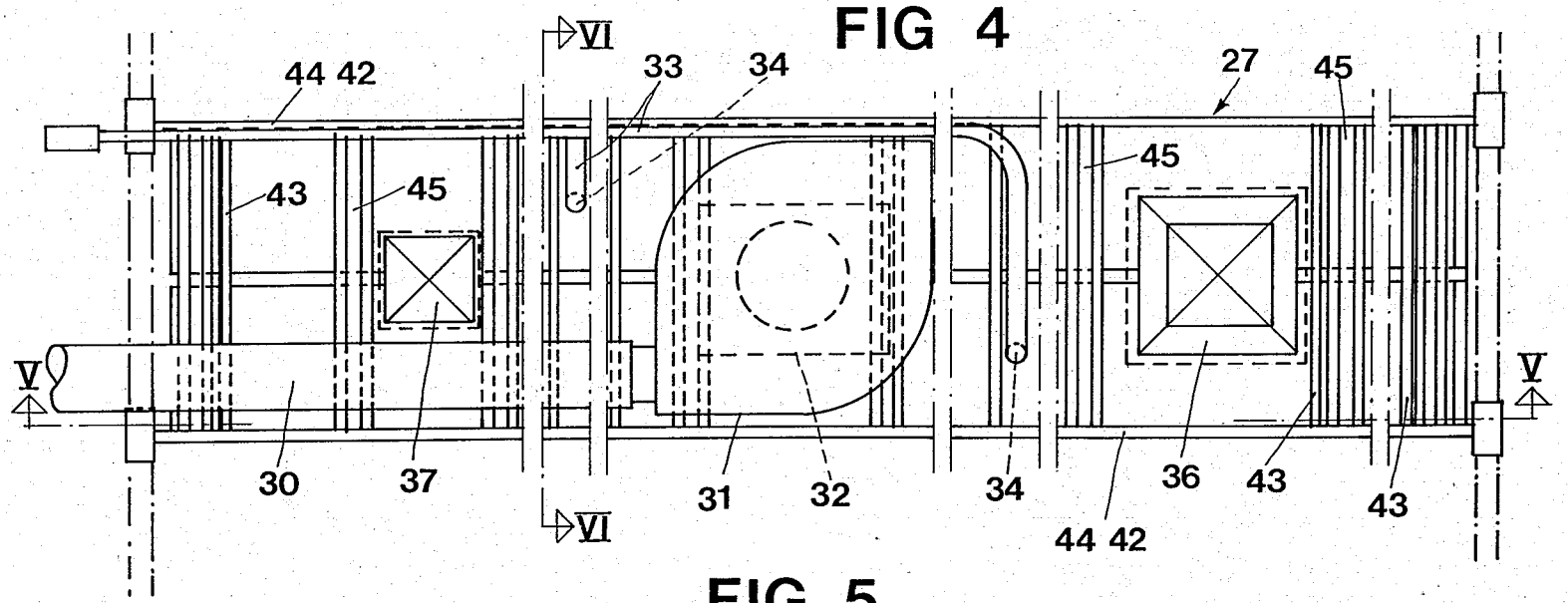

FIG. 4 shows a planar view of a roof beam included in the room element according to the invention.

Figure 5:
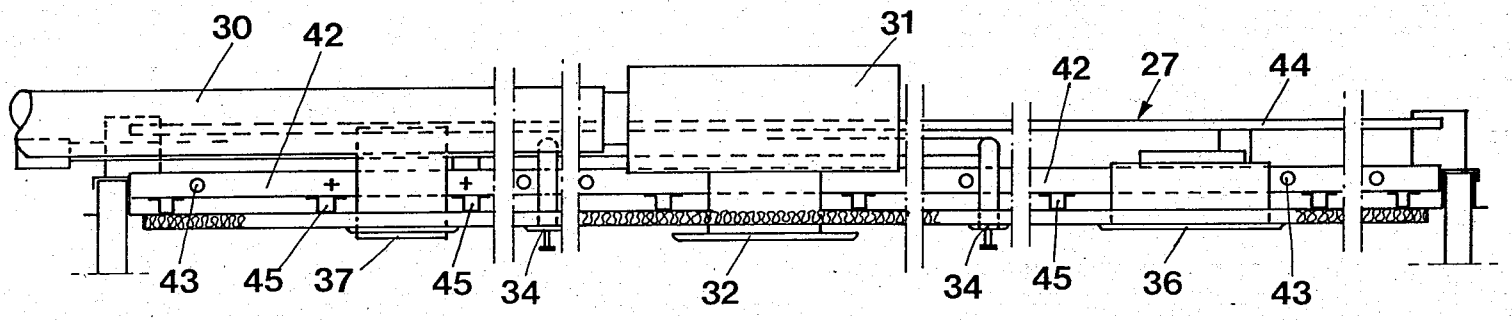

FIG. 5 is a section along line V—V in FIG. 4.

Figure 6:
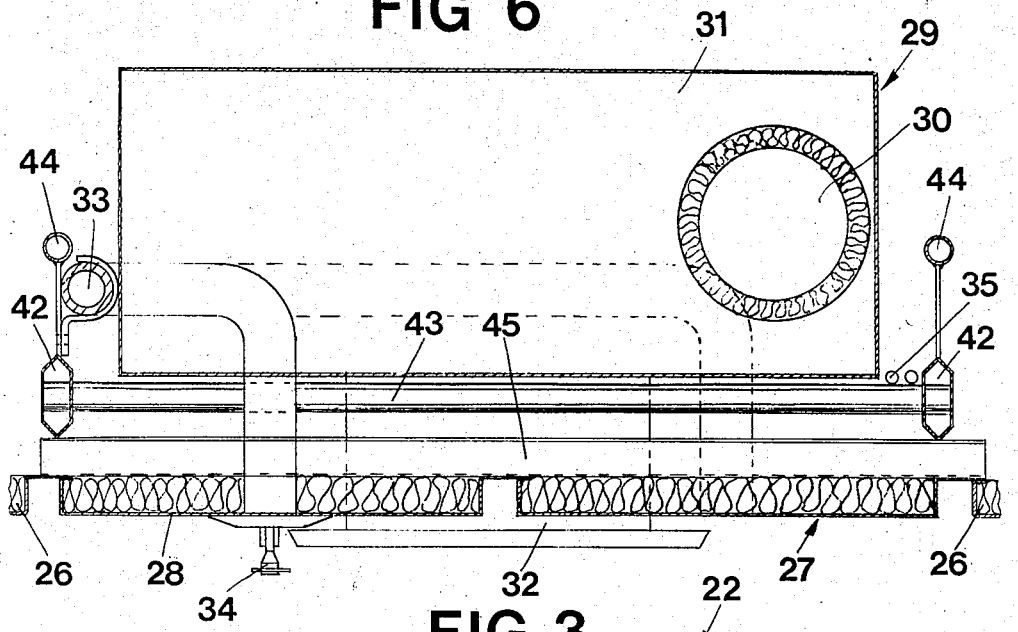

FIG. 6 is a section along line VI—VI in FIG. 4.

Figure 7:
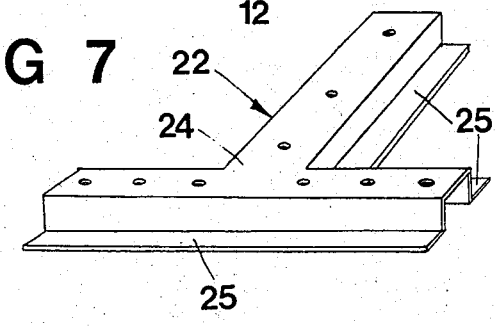
Figure 8:
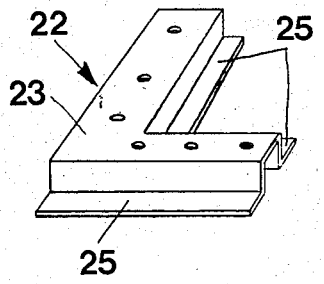

FIGS. 7 and 8 show in perspective connecting sections for connection of the corners of the wall elements.

DESCRIPTION OF THE EMBODIMENTS

Figure 1:
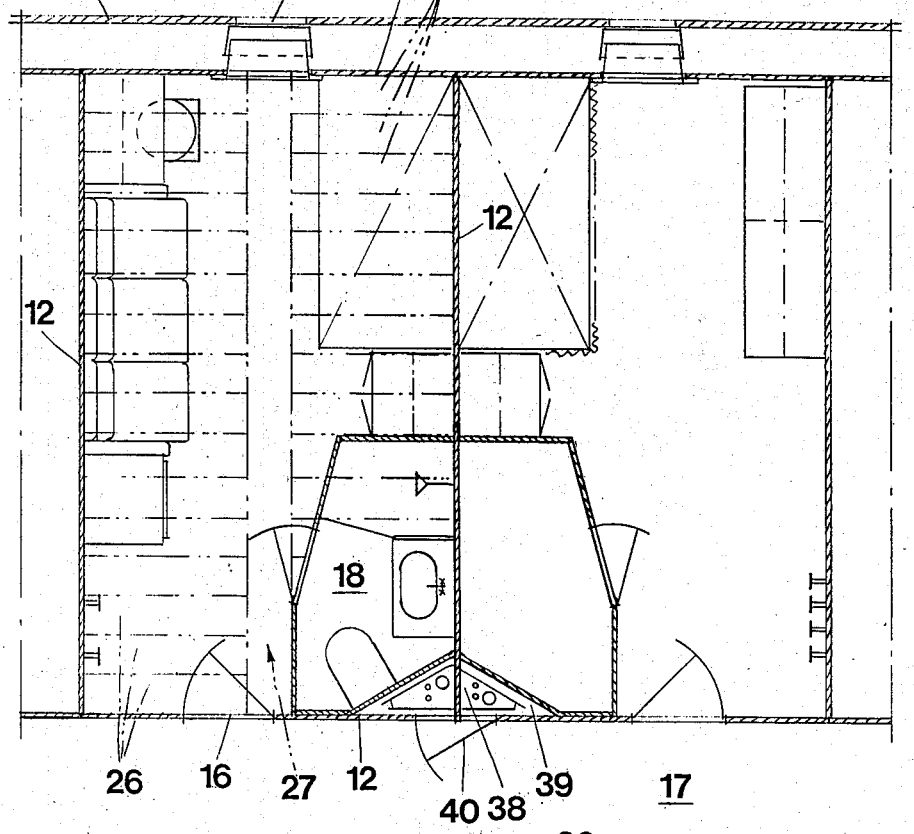
FIG. 1 shows a planar view of two room elements positioned next to each other, for example meant as crew cabins.
Figure 2:
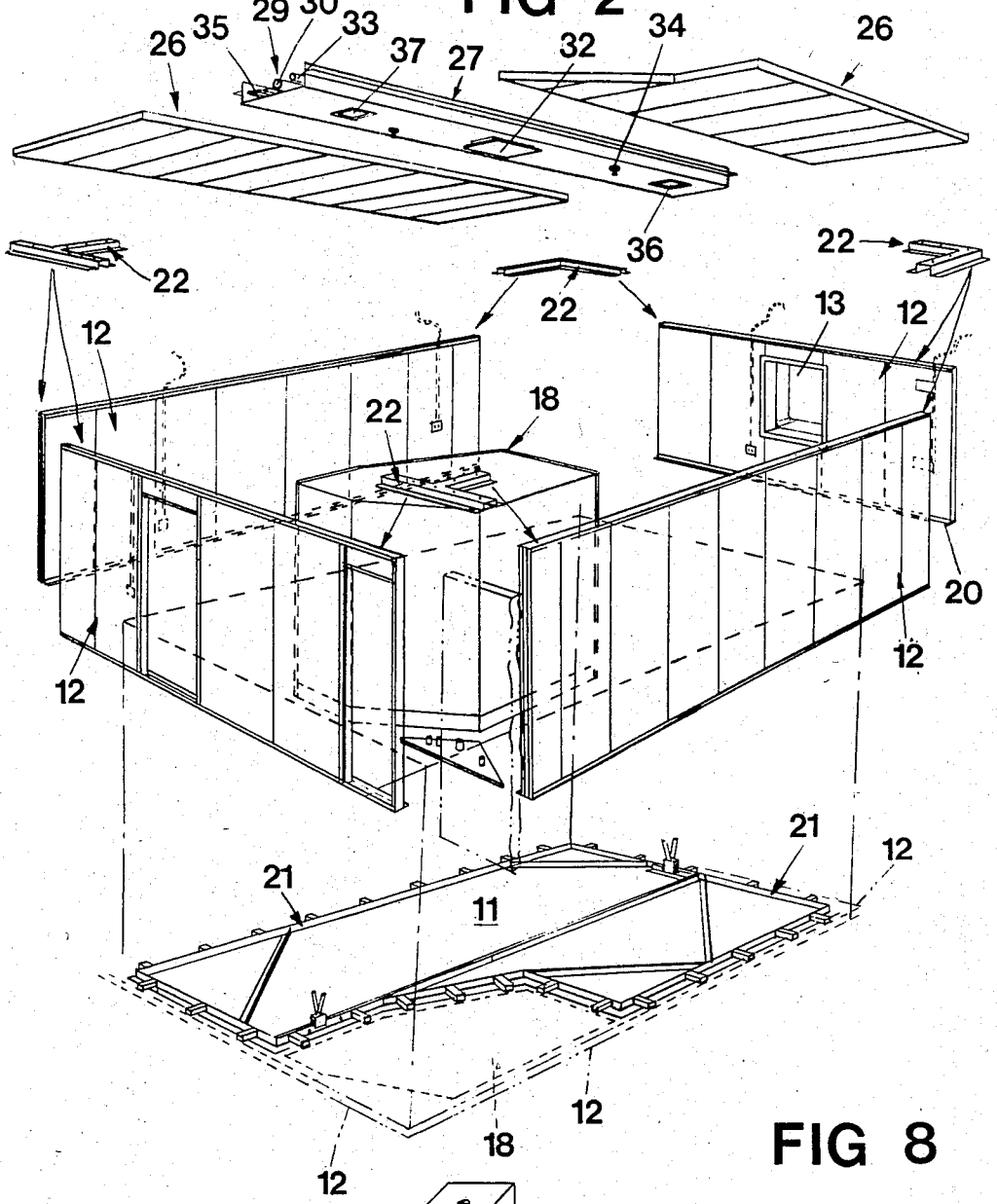
FIG. 2 shows an exploded view in perspective of the left room element of FIG. 1.

The room element according to the invention is intended to be mounted directly on the floor or the deck 11 of a ship. The room element is made of prefabricated self-supported wall elements 12, with or without built-in conduits, two wall elements of which are partition walls between adjacent rooms, one is provided with a window opening 13 intended to be connected to the valve 15 of the outside planking 14, while the opposite wall element is provided with a door 16 which leads to a corridor 17. In the embodiment shown in FIGS. 1 and 2, the shower and toilet room is made as a volume unit, which because of its small size can be easily mounted in place. It is however also possible to let the shower and toilet room be included in the wall system of the room.

The wall elements, which are of conventional construction, as shown in FIG. 3, in their lower part are provided with a bottom profile 19 designated with a flange 20 extending transversely to the wall, which flange can be attached to the deck 11, e.g. by screws. In order to facilitate a correct positioning of the wall elements 12, a fixture 21 is placed on the deck 11, the outside of which serves as a support when mounting the wall elements 12. As these are entirely self-supporting, i.e. they have no connections to the deck construction positioned above or to the outside planking, the necessary staying is provided between the walls by connecting profiles 22 placed on the upper free horizontal end parts, which connecting profiles 23,24 are L- or T-formed as shown in FIG. 7 and 8, except in the corners of the wall element where the profiles are straight. These connecting profiles 22, also called hat profiles, are screwed or riveted onto the wall elements, and they are designed with side flanges 25, which support the ribbed plate ceilings 26. Depending on the width of the room element, the ceiling is divided into three or more sections extending over the total lenght of the room, where the middle section and every second section respectively, are formed by a beam 27, while the side sections are formed by said ribbed plate ceiling 26.

The beam 27, which extends from wall element 12 to wall element 12 and is supported on these, is formed like a modified cable ladder, which consists of ladder steps 43 arranged between stringers 42, and in parallel to the stringers and spaced from these there are attached reinforcing rods 44. The ladder steps are formed as supports for all the supply means 29 required to serve the room. At the side of the stringers turned from the reinforcing rods 44 are arranged cross bars 45, to which are attached a ceiling covering 28, which can be of the same type as the ribbed plate ceilings 26.

FIG. 3 shows a wall, which has many layers of insulation, which makes it suitable as an external wall, whereas FIG. 3a shows the upper part of a corresponding wall with only one insulating layer.

As shown in FIGS. 4–6, upon the beam 27 there is arranged an air escape 30 for supply air and an air treatment device 31 comprising air traps and supply air terminal devices 32, which lastmentioned are arranged on and opens at the lower side of the beam. Furthermore, the beam supports a tube arrangement 33 for the sprinkler system of the ship, with sprinkler nozzles 34, also arranged on the lower side of the beam. Furthermore, on the beam is placed conduits for electric current, for loudspeakers, for common aerials, for telephone, etcetera. Also the armatures 36 and 37 for lighting of the room element are mounted in the beam 27 and inserted in the ribbed plate ceilings 28. All supply means 29 are provided with connecting members at the end of the beam, in such a way that they can be easily connected to the supply mains in the roof of the adjacent corridor 17 and to connecting lines to outlets or the like in the wall elements. While the supply of heat, ventilation, current, etcetera to the rooms is substantially brought about horizontally, the supply tubes 38 for water and sewer are arranged vertically in a shaft 39, which via a door 40 is easily accessible from the corridor 17.

After mounting of the walls and the roof which in principle can be complete, the floor 41 remains, which for example can be made of a usual deck or cast compound and which also hides the flange 20 of the wall element.

Because of the fact that most of the supply means of the room and the armatures which belong thereto are supported by and fixed to the roof of the room, and not in any way are connected to the deck construction of the ship, the time needed for mounting a room element is very short, and the separate members and the beam can be easily transported and mounted by a few persons. This building principle has reduced the price for every room element very much, without reducing the quality and comfort and with maintained or even better possibilities for treatment.

I claim:

1. A room structure for use in a supporting structure having a deck, the supporting structure also providing sources for one or more of electricity, heat, ventilation and like services for the room structure;

the room structure comprising:

a plurality of self-supporting wall members for standing up from the deck; the wall members meeting adjacent ones of the wall members to selectively define one of continuous straight walls and intersecting walls;

the wall members having lower ends, flanges at the lower ends, and means for attaching the flanges to the deck;

the wall members having upper ends; means for interconnecting the upper ends of the adjacent wall members where they meet for defining the continuous straight and the intersecting walls; the interconnecting means comprising longitudinally grooved members shaped for receiving the upper ends of the wall members for holding adjacent wall members together;

a roof comprising a plurality of roof members extending across the room between opposite parallel wall members wherein a first one of the plurality of the roof members for a room comprises a ceiling plate and another of the plurality of roof members comprises a beam; the beam providing a support for the ceiling plate, the beam further comprising a carrier for sources for electricity, heat, ventilation and the like;

the grooved members being of lengths along the upper ends of the wall members that the ceiling plate first roof members rest on the grooved members while the beam does not rest on the grooved members.

2. The room of claim 1, wherein there are at least three of the roof members, with at least two of the ceiling plate first roof members and one of the beams between the two ceiling plates and supporting both of them.

3. The room of claims 2, wherein, moving across the roof of the room, every alternate roof member comprises one of the beams.

4. The room of claim 2, wherein the first roof members comprise ribbed ceiling plates having ribs oriented transverse to the beam.

5. The room of claim 2, wherein the central roof member of the roof comprises one of the beams, that beam also carrying apparatus for utilizing the output of sources for electricity, heat and ventilation.

6. A room structure according to claim 5, wherein the beam is formed of a cable ladder, the ladder comprising a pair of stringers and ladder steps arranged between the stringers, reinforcing rods being arranged in parallel with and attached to the stringers and spaced therefrom, the ladder steps being formed as supports for all the connections; and cross bars arranged at the side of the stringers turned from the reinforcing rods, the first roof members being attached to the cross bars.

7. The room of claim 1, wherein some of the grooved members which meet intersecting walls have a general L-shape.

8. The room of claim 7, wherein some of the grooved members which meet intersecting walls have a T-shape.

* * * * *